US009318049B2

(12) United States Patent
Pak

(10) Patent No.: US 9,318,049 B2
(45) Date of Patent: Apr. 19, 2016

(54) PIXEL, ORGANIC LIGHT EMITTING DISPLAY DEVICE INCLUDING THE SAME, AND METHOD OF OPERATING OF THE ORGANIC LIGHT EMITTING DISPLAY DEVICE

(71) Applicant: SAMSUNG DISPLAY CO., LTD., Yongin, Gyeonggi-Do (KR)

(72) Inventor: Sang-Jin Pak, Gyeonggi-do (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 0 days.

(21) Appl. No.: 14/307,681

(22) Filed: Jun. 18, 2014

(65) Prior Publication Data

US 2014/0368489 A1 Dec. 18, 2014

(30) Foreign Application Priority Data

Jun. 18, 2013 (KR) ..... 10-2013-0069560

(51) Int. Cl.
*G09G 5/00* (2006.01)
*G09G 3/32* (2006.01)

(52) U.S. Cl.
CPC ..... *G09G 3/3233* (2013.01); *G09G 2300/0809* (2013.01); *G09G 2300/0819* (2013.01); *G09G 2300/0852* (2013.01); *G09G 2310/0251* (2013.01); *G09G 2310/0297* (2013.01); *G09G 2320/0295* (2013.01); *G09G 2320/043* (2013.01); *G09G 2320/045* (2013.01)

(58) Field of Classification Search
None
See application file for complete search history.

(56) References Cited

U.S. PATENT DOCUMENTS

| | | | | |
|---|---|---|---|---|
| 7,379,044 | B2 * | 5/2008 | Kageyama et al. | 345/96 |
| 2004/0070558 | A1 | 4/2004 | Cok et al. | |
| 2008/0252568 | A1 | 10/2008 | Kwon | |
| 2009/0051628 | A1 * | 2/2009 | Kwon | 345/77 |
| 2012/0113077 | A1 | 5/2012 | Kang | |

FOREIGN PATENT DOCUMENTS

| | | |
|---|---|---|
| KR | 100846970 | 7/2008 |
| KR | 1020120048294 | 5/2012 |

* cited by examiner

*Primary Examiner* — Kathy Wang-Hurst
*Assistant Examiner* — Matthew Yeung
(74) *Attorney, Agent, or Firm* — F. Chau & Associates, LLC

(57) ABSTRACT

An organic light emitting display device includes a plurality of data lines, a scan driver, a sensing control line driver, a data driver, and a switching unit. The scan driver supplies a scan signal to a plurality of scan lines. The sensing control line driver supplies a sensing control signal to a plurality of sensing control lines. The data driver supplies a data signal to a plurality of data output lines. The switching unit selectively couples each data line to one of a corresponding data output line and a corresponding sensing line. The switching unit further selectively supplies a write control signal to each write control line.

14 Claims, 4 Drawing Sheets

PIXEL, ORGANIC LIGHT EMITTING DISPLAY DEVICE INCLUDING THE SAME, AND METHOD OF OPERATING OF THE ORGANIC LIGHT EMITTING DISPLAY DEVICE

CROSS-REFERENCE TO RELATED APPLICATION

This application claims priority to Korean Patent Application No. 10-2013-0069560, filed on Jun. 18, 2013 in the Korean Intellectual Property Office, the disclosure, of which is incorporated by reference herein in their entire.

TECHNICAL FIELD

The present invention relates to a pixel and an organic light emitting display device including the same.

DISCUSSION OF RELATED ART

Organic light emitting display device display images using organic light emitting diodes (OLEDs) that emit light through recombination of electrons and holes. The organic light emitting display devices have a fast response speed and are driven with low power consumption.

SUMMARY

According to an exemplary embodiment of the present invention, a pixel includes an organic light emitting diode, a precharge circuit, a pixel circuit, and a sensing control circuit. The precharge circuit charges a first voltage corresponding to a data signal supplied through a data line when a scan signal is supplied through a scan line. The pixel circuit charges a second voltage corresponding to the first voltage when a write control signal is supplied through a write control line. The pixel circuit further supplies current corresponding to the charged second voltage from a first power source to a second power source via the organic light emitting diode. The sensing control circuit couples the data line to an anode electrode of the organic light emitting diode in response to a sensing control signal supplied through a sensing control line.

According to an exemplary embodiment of the present invention, an organic light emitting display device includes a plurality of data lines, a scan driver, a sensing control line driver, a data driver, and a switching unit. The scan driver supplies a scan signal to a plurality of scan lines. The sensing control line driver supplies a sensing control signal to a plurality of sensing control lines. The data driver supplies a data signal to a plurality of data output lines. The switching unit selectively couples each data line to one of a corresponding data output line and a corresponding sensing line. The switching unit further selectively supplies a write control signal to each write control line.

According to an exemplary embodiment of the present invention, a method of driving an organic light emitting display is provided. A write control signal is generated, and is not selectively supplied to one write control signal line of a plurality of a control signal lines. The write control signal is supplied to remaining write control signal lines of the plurality of the control signal lines. First pixels emits light based on first data signals of first data lines corresponding to the remaining write control signal lines. Degradation information of an organic light emitting diode or threshold voltage/mobility information of a driving transistor of each of second pixels of a second data line is sensed. The second data line corresponds to the one write control signal that does not supply the write control signal. The second pixels do not emit light.

BRIEF DESCRIPTION OF DRAWINGS

These and other features of the present invention will become more apparent by describing exemplary embodiments thereof with reference to the accompanying drawings of which.

DETAILED DESCRIPTION OF THE EMBODIMENTS

Figure 1:
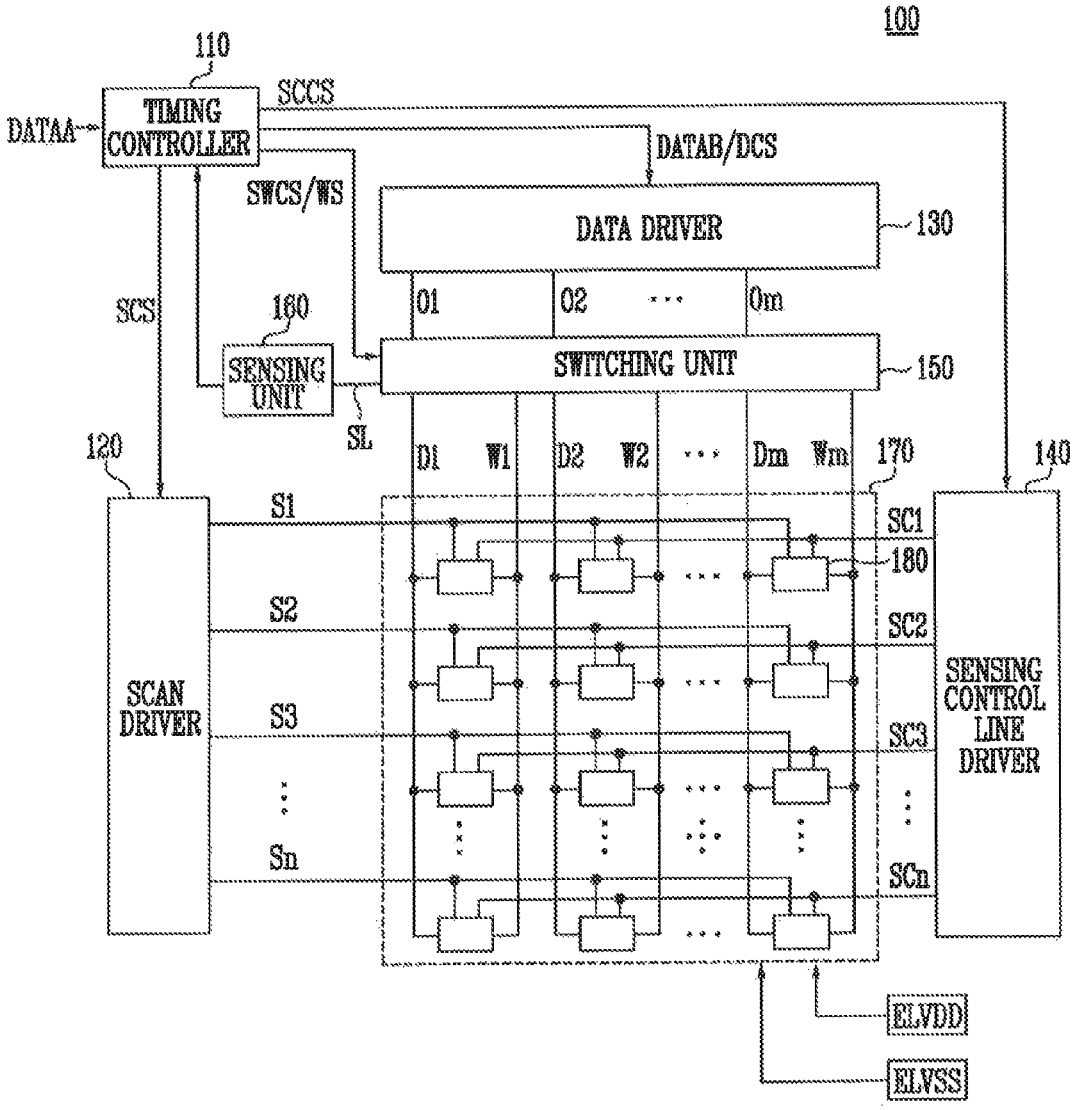
FIG. 1 is a diagram illustrating an organic light emitting display device according to an exemplary embodiment of the present invention.

Exemplary embodiments of the inventive concept will be described below in detail with reference to the accompanying drawings. However, the inventive concept may be embodied in different forms and should not be construed as limited to the embodiments set forth herein. In the drawings, the thickness of layers and regions may be exaggerated for clarity. It will also be understood that when an element is referred to as being "coupled" or "connected" to another element, it may be directly coupled or connected to the other element, or intervening elements may also be present. Like reference numerals may refer to the hike elements throughout the specification and drawings.

FIG. 1 is a diagram illustrating an organic light emitting display device according to an exemplary embodiment of the present invention.

Referring to FIG. 1, an organic light emitting display device 100 according to this exemplary embodiment includes a timing controller 110, a scan driver 120, a data driver 130, a sensing control line driver 140, a switching unit 150, a sensing unit 160 and a pixel unit 170.

The timing controller 110 controls operations of the scan driver 120, the data driver 130, the sensing control line driver 140 and the switching unit 150. The timing controller 110 generates a second data DATAB by converting a first data DATAA supplied from the outside of the organic light emitting display device 100, based on information stored in the sensing unit 160, and outputs the generated second data DATAB to the data driver 130.

For example, the timing controller 110 generates a scan driving control signal SCS, in response to a synchronization signal (not shown) supplied from the outside of the organic light emitting display device 100, and supplies the generated scan driving control signal SCS to the scan driver 120. The timing controller 110 generates a data driving control signal DCS and supplies the generated data driving control signal DCS to the data driver 130. The timing controller 110 generates a sensing control line control signal SCCS and supplies the generated sensing control line control signal SCCS to the sensing control line driver 140. The timing controller 110 generates a switching control signal SWCS and supplies, to the switching unit 150, the generated switching control signal SWCS together with a write control signal WS.

The scan driver 120 supplies a scan signal to scan lines S1 to Sn, under the control of the timing controller 110, i.e., in response to the scan driving control signal SCS output from the timing controller 110.

The data driver 130 aligns the second data DATAB supplied from the timing controller 110, under the control of the timing controller 110, i.e., in response to the data driving control signal DCS output from the timing controller 110.

The sensing control line driver 140 supplies a first sensing control signal and a second sensing control signal to sensing control lines SC1 to SCn, under the control of the timing controller 110, i.e., in response to the sensing control line control signal SCCS output from the timing controller 110.

The switching unit 150 allows data lines D1 to Dm to be selectively coupled to data output lines O1 to Om or a sensing line SL, and supplies the write control signal WS to write control lines W1 to Wm.

Waveforms of the scan signal, the data signal, the sensing control signals and the write control signal will be described with reference to FIGS. 6 and 7.

The sensing unit 160 extracts degradation information of an organic light emitting diode included in each pixel 180 and stores the extracted degradation information. The sensing unit 160 extracts threshold voltage/mobility information of a driving transistor included in each pixel 180 and stores the extracted threshold voltage/mobility information. The sensing unit 160 supplies the stored information to the timing controller 110.

The detailed structure and operation of the sensing unit 160 will be described with reference to FIG. 5.

The pixel unit 170 includes pixels 180 arranged in a matrix structure defined by a plurality of rows and a plurality of columns. For example, each pixel 180 is disposed at an intersection of each scan line S1 to Sn, each data line D1 to Dm, each write control line W1 to Wm and each sensing control line SC1 to SCn. The scan lines S1 to Sn and the sensing control lines SC1 to SCn are arranged along horizontal lines, and the data lines D1 to Dm and the write control lines W1 to Wm are arranged along vertical lines.

The pixels 180 emit light or are sensed, in response to control signals supplied from the scan lines S1 to Sn, the data lines D1 to Dm, the write control lines W1 to Wm and the sensing control lines SC1 to SCn.

Figure 2:
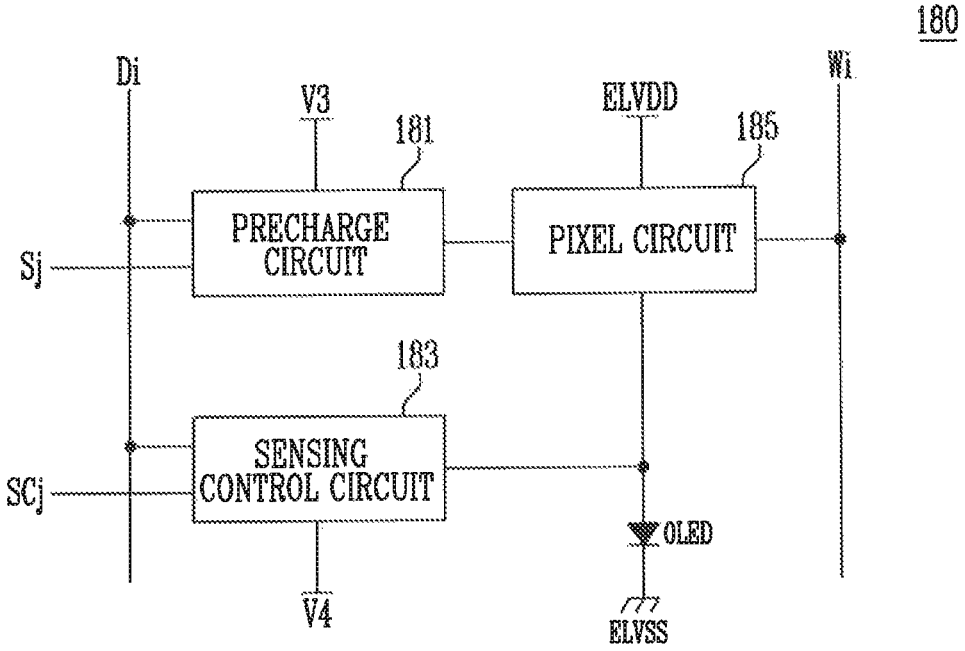
FIG. 2 is a diagram illustrating a pixel structure according to an exemplary embodiment of the present invention.

FIG. 2 is a diagram illustrating a pixel structure according to an exemplary embodiment. A pixel 180 disposed on an i-th is a natural number which is greater than 0 and equal to or smaller than m) vertical line and a j-th (j is a natural number which is greater than 0 and equal to or smaller than n) horizontal line is of FIG. 2.

Referring to FIG. 2, the pixel 180 includes a precharge circuit 181, a sensing control circuit 183, a pixel circuit 185 and an organic light emitting diode OLED.

The precharge circuit 181 is coupled to a data line Di, a scan line Sj, a third power source V3 and the pixel circuit 185. The precharge circuit 181 generates a first voltage corresponding to a data signal supplied through the data line Di when a scan signal is supplied through the scan line Sj.

The sensing control circuit 183 is coupled among the data line Di, a sensing control line SCj, the pixel circuit 185 and an anode electrode of the organic light emitting diode OLED. The sensing control circuit 183 allows the data line Di and the anode electrode of the organic light emitting diode OLED to be coupled to each other, in response to the first sensing control signal supplied through the sensing control line SCj, and allows the data line Di and the anode electrode of the organic light emitting diode OLED to be decoupled from each other, in response to the second sensing control signal supplied through the sensing control line SCj. The first and second control signals will be described with reference to FIG. 7.

The pixel circuit 185 is coupled to the precharge circuit 181, a first power source ELVDD, a write control signal line Wi, the sensing control circuit 183 and the anode electrode of the organic light emitting diode OLED. The pixel circuit 185 charges a second voltage corresponding to the first voltage charged in the precharge Circuit 181 when a write control signal is supplied through the write control signal line Wi, and supplies current corresponding to the charged second voltage from the first power source ELVDD to a second power source ELVSS via the organic light emitting diode OLED.

The organic light emitting diode OLED emits light with a luminance corresponding to the current supplied from the pixel circuit 185.

Figure 3:
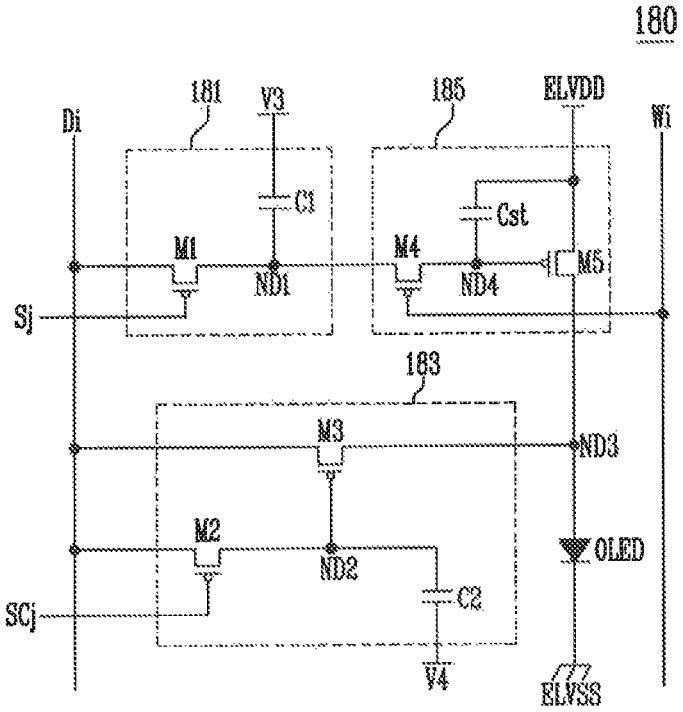
FIG. 3 is a circuit diagram illustrating a precharge circuit, a pixel circuit and a sensing control circuit according to an exemplary embodiment of the present invention.

FIG. 3 is a circuit diagram illustrating a precharge circuit, a pixel circuit and a sensing control circuit according to an exemplary embodiment. The structures of the precharge circuit, the pixel circuit and the sensing control circuit, of FIG. 3, are illustrative, and the present invention is not limited thereto.

Referring to FIG. 3, the precharge circuit 181 includes a first transistor M1 and a first capacitor C1.

The first transistor M1 is coupled between the data line Di and a first node ND1. The first transistor M1 is turned on in response to the scan signal supplied through the scan line Sj. The first capacitor C1 is coupled between the third power source V3 and the first node ND1.

The first capacitor C1 charges the first voltage corresponding to the data signal supplied through the data line Di when the first transistor M1 is turned on.

The sensing control circuit 183 includes a second transistor M2, a third transistor M3 and a second capacitor C2.

The second transistor M2 is coupled between the data line Di and a second node ND2. The second transistor M2 is turned on when the first or second sensing control signal is supplied through the sensing control signal line SDj.

The third transistor M3 is coupled between the data line Di and a third node ND3. The third transistor M3 is turned on in response to a voltage at the second node ND2.

The second capacitor C2 charges a voltage corresponding to the voltage applied from the data line Di when the second transistor M2 is turned on. As of FIG. 7, the data signal is supplied through the data line Di when the first sensing control signal SECS1 is supplied to the second transistor M2. Thus, the second capacitor C2 charges a third voltage corresponding to the data signal supplied through the data line Di when the second transistor M2 is turned on in response to the first sensing control signal SECS1. On the contrary, the data signal is not supplied through the data line Di when the second sensing signal SECS2 is supplied. Thus, the second capacitor C2 discharges the charged third voltage through the data line Di when the second transistor M2 is turned on in response to the second sensing control signal SECS2.

Accordingly, the third transistor M3 is turned on during a period before the second sensing control signal SECS2 is supplied after the first sensing control signal SECS1 is supplied.

The pixel circuit 185 includes a fourth transistor M4, a fifth transistor M5 and a third capacitor Cst.

The fourth transistor M4 is coupled between the first node MDI and a fourth node ND4. The fourth transistor M4 is turned on when the write control signal is supplied through the write control signal line Wi.

The third capacitor Cst is coupled between the first power source ELVDD and the fourth node ND4. The third capacitor Cst charges the second voltage corresponding to the first voltage charged in the first capacitor C1 when the fourth transistor M4 is turned on.

The fifth transistor M5 supplies current corresponding to the second voltage charged in the third capacitor Cst from the first power source ELVDD to the second power source ELVES via the organic light emitting diode OLED.

Although it has been illustrated in FIGS. 2 and 3 that the first power source ELVDD and the third power source V3 are different power sources, the present invention is not limited thereto. For example, the first power source ELVDD and the third power source V3 may be the same power source. The first power source ELVDD and the third power source V3 may have substantially the same voltage, for example.

In addition, although it has been illustrated in FIGS. 2 and 3 that the second power source ELVSS and a fourth power source V4 are different power sources, the present invention is not limited thereto. For example, the second power source ELVSS and the fourth power source V4 may be the same power source. The second power source ELVSS and the fourth power source V4 may be set to the same voltage, for example, FIG. 4 is a circuit diagram illustrating a switching unit according to an exemplary embodiment.

Figure 4:
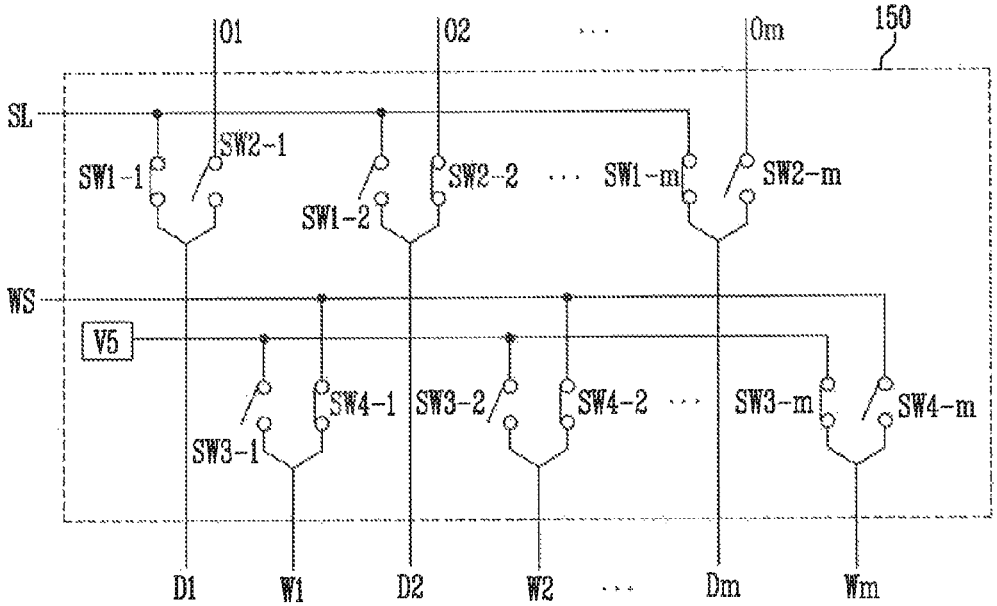
FIG. 4 is a circuit diagram illustrating a switching unit according to an exemplary embodiment of the present invention.

Referring to FIG. 4, the switching unit 150 includes first switches SW1-1 to SW1-*m*, second switches SW2-1 to SW2-*m*, third switches SW3-1 to SW3-*m* and fourth switches SW4-1 to SW4-*m*.

Each of the first switches SW1-1 to SW1-*m*, the second switches SW2-1 to SW2-*m*, the third switches SW3-1 to SW3-*m* and the fourth switches SW4-1 to SW4-*m* is turned on or turned off in various manners in response to the switching control signal SWCS that the timing controller 110 generates.

Each first switches SW1-1 to SW1-*m* and each second switches SW2-1 to SW2-*m* form a pair of switch that selectively couples each data line D1 to Dm to each data output line O1 to Om or the sensing line SL. The first switches SW1-1 to SW1-*m* and the second switches SW2-1 to SW2-*m* allows the data lines D1 to Dm to be selectively coupled to the data output lines O1 to Om or the sensing line SL.

Figure 7:
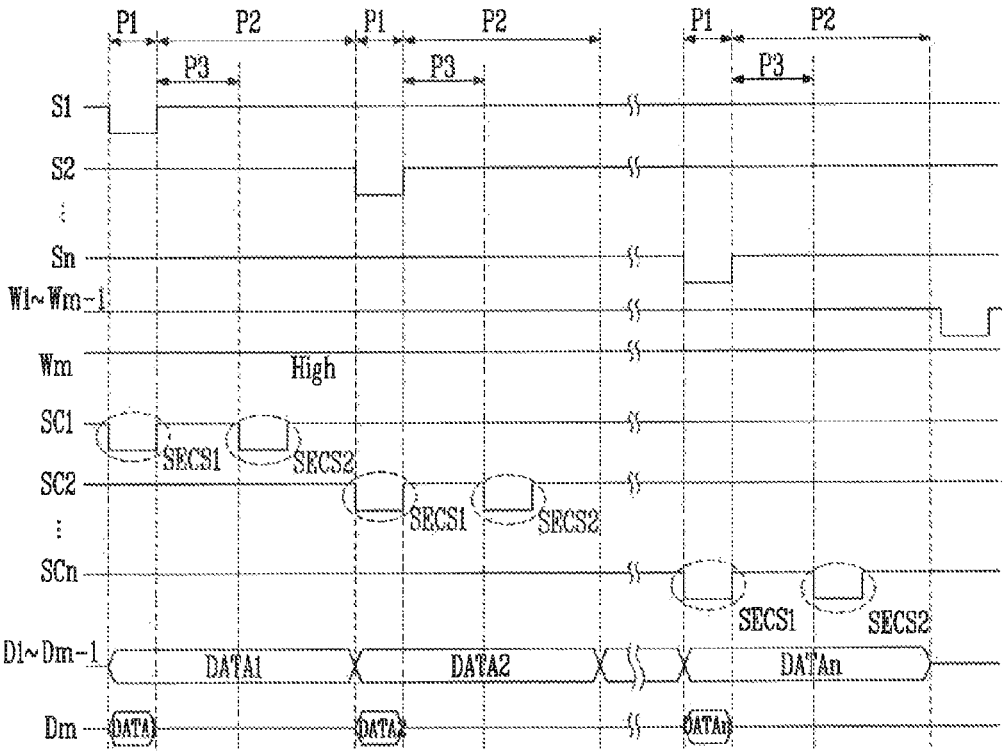
FIG. 7 is a timing diagram illustrating an operation of an organic light emitting display device during a sensing frame according to an exemplary embodiment of the present invention.

For example, when pixels coupled to an m-th data line Dm is sensed, a switch SW1-*m* among the first switches SW1-1 to SW1-*m* is turned off during a first period (P1 of FIG. 7), and is turned on during a second period (P2 of FIG. 7). On the contrary, a switch SW2-*m* among the second switches SW2-1 to SW2-*m* is turned on during the first period (P1 of FIG. 7), and is turned off during the second period (P2 of FIG. 7). In this case, the other switches except the switch SW1-*m* among the first switches SW1-1 to SW-m are turned off, and the other switches except the switch SW2-*m* among the second switches SW2-1 to SW2-*m* are turned on.

The third switches SW3-1 to SW3-*m* and the fourth switches SW4-1 to SW4-*m* selectively supply the write control signal WS or a fifth power source V5 to the write control signal lines W1 to Wm. Here, the fifth power source V5 is set to a high-level voltage, i.e., a voltage at which the fourth transistor M4 is turned off.

For example, when the pixels coupled to the m-th data line Dm are sensed, only a switch SW3-*m* among the third switches SW3-1 to SW3-*m* is turned on, and only a switch SW4-*m* among the fourth switches SW4-1 to SW4-*m* is turned off.

Figure 5:
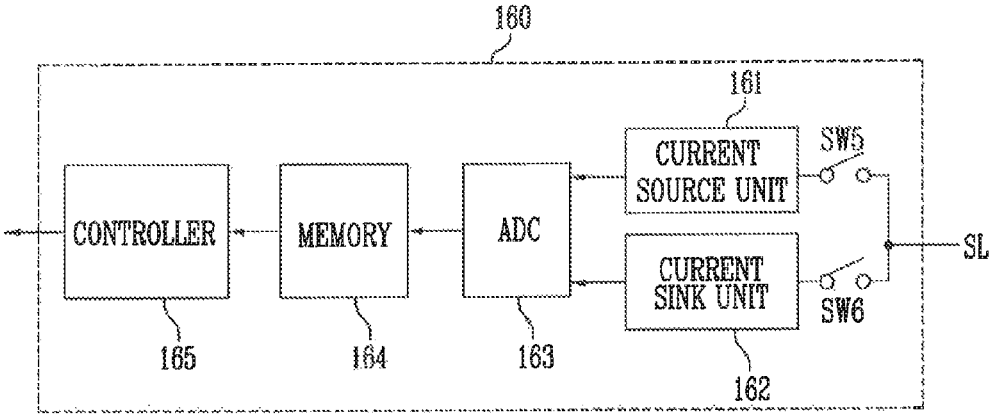
FIG. 5 is a diagram illustrating a sensing unit according to an exemplary embodiment of the present invention.

FIG. 5 is a diagram illustrating a sensing unit according to an exemplary embodiment.

Referring to FIG. 5, the sensing unit 160 includes a plurality of switches SW5 and SW6, a current source unit 161, a current sink unit 162, an analog-to-digital converter (ADC) 163, a memory 164 and a controller 165.

The fifth switch SW5 controls the coupling between the current source unit 161 and the sensing line SL. For example, the fifth switch SW5 is turned on when degradation information of the organic light emitting diode OLED is sensed.

The sixth switch SW6 controls the coupling between the current sink unit 162 and the sensing line SL. For example, the sixth switch SW6 is turned on when threshold voltage/mobility information of the driving transistor, e.g., the fifth transistor M5 is sensed.

The current source unit 161 senses the degradation information of the organic light emitting diode OLED while supplying a certain current to the pixel 180 when the fifth switch SW5 is turned on. In other words, the current source unit 161 supplies the certain current to the organic light emitting diode OLED of the pixel 180, and outputs, to the ADC 163, a voltage to measure the I-V characteristics of the organic light emitting diode OLED.

The current sink unit 162 receives a predetermined current supplied from the pixel 180 when the sixth switch SW6 is turned on, and senses the threshold voltage/mobility information of the driving transistor included in the pixel 180, using the predetermined current. For example, the current sink unit 162 receives a predetermined current supplied from the pixel 180 through the switching unit 150 when the sixth switch SW6 is turned on, and outputs, to the ADC 163, a voltage corresponding to the predetermined current supplied from the pixel 180.

The ADC 163 converts the voltage applied from the current source unit 161 into a first digital value, and converts the voltage applied from the current sink unit 162 into a second digital value.

The memory 164 stores the first and second digital values supplied from the ADC 163. For example, the memory 164 stores first and second digital values of all the pixels 180 included in the pixel unit 170. According to an exemplary embodiment, the memory 164 may be implemented as a frame memory.

The controller 165 transmits the first and second digital values stored in the memory 164 to the timing controller 110. Here, the controller 165 transmits, to the timing controller 110, the first and second digital values extracted from the pixel 180 to which the first data DATAA currently input from the timing controller 110 is to be supplied.

Figure 6:
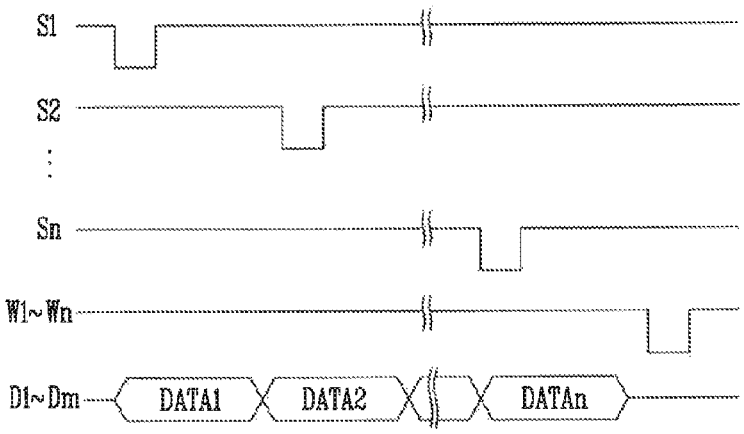
FIG. 6 is a timing diagram illustrating an operation of an organic light emitting display device during a display frame according to an exemplary embodiment of the present invention.

FIG. 6 is a timing diagram illustrating an operation of an organic light emitting display device during a display frame according to an exemplary embodiment.

For convenience of description, the frame, in which each pixel emits light with luminance corresponding to the data signal supplied through the data line, is referred to as a 'display frame', and the frame, in which the threshold voltage/mobility information of the driving transistor included in each pixel arranged on one vertical line or the degradation information of the organic light emitting diode included in each pixel is sensed, is referred to as a 'sensing frame'.

Referring to FIG. 6, the scan driver 120 supplies a scan signal to the scan lines S1 to Sn during the display frame. In this case, the data driver 130 supplies data signals to the data output lines O1 to Om, and the switching unit 150 allows the data output lines O1 to Om to be coupled to the data lines D1 to Dm.

For example, when the scan driver 120 supplies a scan signal to i-th scan line, the data driver 130 supplies, to the data lines D1 to Dm, data signals to be supplied to pixels 180 arranged on an i-th horizontal line, through the switching unit 150.

For example, when the scan driver 120 supplies a scan signal to a first scan line S1, the data driver 130 supplies data signals DATA1 to the data lines D1 to Dm. When the scan driver 120 supplies the scan signal to a second scan line S2, the data driver 130 supplies data signals DATA2 to the data lines D1 to Dm.

In this case, the precharge circuit 181 included in the pixel 180 charges a first voltage corresponding to the data signal supplied to a corresponding data line when the scan signal is supplied to a corresponding scan line.

After the scan driver 120 supplies the scan signal to the n-th scan line Sn, the switching unit supplies a write control signal WS to the write control lines W1 to Wm.

In this case, the pixel circuit 185 included in the pixel 180 charges a second voltage corresponding to the first voltage charged in the precharge circuit 181, in response to the write control signal WS supplied through a corresponding write control line, and supplies, to the organic light emitting diode OLED, current corresponding to the charged second voltage.

FIG. 7 is a timing diagram illustrating an operation of an organic light emitting display device during a sensing frame according to an exemplary embodiment, FIG. 7 illustrates a signal waveform diagram when pixels arranged on an m-th vertical line are sensed.

Referring to FIG. 7, the control signals supplied to the other pixels except the pixels arranged on the m-th vertical line, which are sensed during the sensing frame, are equal to those supplied during the display frame. For example, the pixels not sensed even during the sensing frame are normally operated to display an image.

During the sensing frame, the switching unit 150 does not supply the write control signal WS to the m-th write control line Wm. For example, the switch SW3-*m* of FIG. 4 is turned on and the switch SW4-*m* of FIG. 4 is turned off, so that the switching unit 150 applies the voltage of the fifth power source V5 to the m-th write control line Wm.

During the sensing frame, the sensing control line driver 140 supplies the first and second sensing control signals SECS1 and SECS2 to the sensing control liens SC1 to SCn. For example, the sensing control line driver 140 supplies the first and second sensing control signals SECS1 and SECS2, which are consecutive, to the sensing control signal lines SC1 to SCn.

For example, the sensing control line driver 140 supplies the first and second sensing control signals SECS1 and SECS2 to a first sensing control line SC1, and then supplies the first and second sensing control signals SECS1 and SECS2 to a second sensing control line SC2. The sensing control line driver 140 sequentially supplies the first and second sensing control signals SECS1 and SECS2 from the first sensing control line SC1 to a last sensing control line SCn.

Although it has been illustrate in FIG. 7 that the first sensing control signal SECS1 and the scan signal are supplied during the same period, the present invention is not limited thereto.

The switching unit 150 allows the m-th data output line Om to be coupled to the m-th data line Dm during the first period P1, and allows the sensing line SL to be coupled to the m-th data line Dm during the second period P2. For example, the data signal is supplied to the m-th data line Dm during the first period P1, and the sensing unit 160 senses the pixels 180 through the m-th data lines Dm during the second period P2.

During the first period P1, the second transistor M2 of the sensing control circuit 183 is turned on in response to the first sensing control signal SECS1. In this case, the second capacitor C2 charges a third voltage corresponding to the data signal supplied through the corresponding data line Dm.

For example, the second transistor M2 of the sensing control circuit 185 included in the pixel 180 disposed at the intersection of the first horizontal line and the m-th vertical line is turned on in response to the first sensing control signal SECS1 supplied through the first sensing control line SC1, and the second capacitor C2 charges the third voltage corresponding to the data signal DATA1 supplied through the m-th data line Dm.

During the second period P2, the second transistor M2 of the sensing control circuit 183 is turned on in response to the first sensing control signal SECS1. In this case, the data signal is not supplied through the data line Dm, and therefore, the second capacitor C2 discharges the charged second voltage.

The third transistor M3 is turned on in response to the voltage at the second node ND2. Therefore, the third transistor M3 is turned on from after the first sensing control signal SECS1 is supplied to before the second sensing control signal SECS2 is supplied.

The sensing unit 160 senses degradation information of the organic light emitting diode OLED included in the pixel 180 in which the third transistor M3 is turned on or threshold voltage/mobility of the driving transistor included in the pixel 180 in which the third transistor M3 is turned on.

In the organic light emitting display device according to an exemplary embodiment, threshold voltage/mobility information of driving transistors included in pixels arranged on one vertical line or degradation information of organic light emitting diodes included in the pixels arranged on the one vertical line may be sensed during one frame, e.g., the sensing frame, so that it is possible to perform exact compensation, thereby always displaying an image with uniform luminance.

By compensating changes of threshold voltage/mobility of driving transistors or compensating the degradation of the organic light emitting diode according to an exemplary embodiment, an organic light emitting display device may display an image with uniform luminance.

While the present inventive concept has been shown and described with reference to exemplary embodiments thereof, it will be apparent to those of ordinary skill in the art that various changes in form and detail may be made therein without departing from the spirit and scope of the inventive concept as defined by the following claims.

What is claimed is:

1. A pixel comprising:

an organic light emitting diode;

a precharge circuit charging a first voltage corresponding to a data signal supplied through a data line when a scan signal is supplied through a scan line;

a pixel circuit charging a second voltage corresponding to the first voltage when a write control signal is supplied through a write control line, and supplying current corresponding to the charged second voltage from a first power source to a second power source via the organic light emitting diode; and a sensing control circuit coupling the data line to an anode electrode of the organic light emitting diode, in response to a sensing control signal supplied through a sensing control line, wherein the sensing control circuit includes:

a second transistor coupled between the data line and a second node, the second transistor being turned on in response to the sensing control signal;

a second capacitor coupled between the second node and a fourth rower source; and a third transistor coupled between the data line and the anode electrode of the organic light emitting diode, the third transistor being turned on in response to a voltage at the second node, wherein the second capacitor charges a third voltage corresponding to the data signal supplied through the data line, when the second transistor is turned on, in response to a first sensing control signal of the sensing control signal, and wherein the second capacitor discharges the third voltage charged to the data line, when the second transistor is turned on and when the data signal is not supplied to the data line, in response to a second sensing control signal of the sensing control signal.

2. The pixel of claim 1, wherein the precharge circuit includes:

a first transistor coupled between the data line and a first node, the first transistor being turned on in response to the scan signal; and a first capacitor coupled between a third power source and the first node.

3. The pixel of claim 2, wherein the first capacitor charges the first voltage when the first transistor is turned on.

4. The pixel of claim 2, wherein the first and third power sources are set to substantially the same voltage.

5. The pixel of claim 1, wherein the second and fourth power sources are set to substantially the same voltage.

6. The pixel of claim 2, wherein the pixel circuit includes:

a fourth transistor coupled between the first node and a fourth node, the fourth transistor being turned on in response to the write control signal;

a third capacitor coupled between the first power source and the fourth node; and a fifth transistor supplying the current corresponding to the second voltage charged in the third capacitor from the first power source to the second power source via the organic light emitting diode.

7. The pixel of claim 6, wherein the third capacitor charges the second voltage corresponding to the first voltage charged in the first capacitor when the fourth transistor is turned on.

8. An organic light emitting display device, comprising:

a plurality of data lines;

a scan driver supplying a scan signal to a plurality of scan lines;

a sensing control line driver supplying a sensing control signal to a plurality of sensing control lines;

a data driver supplying a data signal to a plurality of data output lines;

a switching unit coupling each data line to one of a corresponding data output line and a corresponding sensing line and supplying a write control signal to each write control line;

a pixel disposed at an intersection of an i-th data line of the plurality of the data lines and a j-th (j is a natural number) scan line of the plurality of the scan lines, wherein the pixel includes:

an organic light emitting diode;

a precharge circuit charging a first voltage corresponding to a data signal supplied through the i-th data line when a scan signal is supplied through the j-th scan line;

a pixel circuit charging a second voltage corresponding to the first voltage when a write control signal is supplied through an i-th write control line of the plurality of the write control lines, and supplying current corresponding to the charged second voltage from a first power source to a second power source via the organic light emitting diode, wherein the i-th write control line is extended in parallel to the i-th data line; and a sensing control circuit coupling the i-th data line and an anode electrode of the organic light emitting diode in response to a sensing control signal supplied through a j-th sensing control line of the plurality of the sensing control line, wherein the sensing control circuit includes:

a second transistor coupled between the data line and a second node, the second transistor being turned on in response to the sensing control signal;

a second capacitor coupled between the second node and a fourth power source; and a third transistor coupled between the data line and the anode electrode of the organic light emitting diode, the third transistor being turned on in response to a voltage at the second node, and wherein the second capacitor charges a third voltage corresponding to the data signal supplied through the data line, when the second transistor is turned on, in response to a first sensing control signal of the sensing control signal, and wherein the second capacitor discharges the third voltage charged to the data line, when the second transistor is turned on and when the data signal is not supplied to the data line, in response to a second sensing control signal of the sensing control signal.

9. The organic light emitting display device of claim 8, further comprising a sensing unit sensing degradation information of the organic light emitting diode or threshold voltage/mobility information of a driving transistor included in the pixel circuit using the sensing line.

10. The organic light emitting display device of claim 9, wherein when the pixel coupled to the i-th data line is sensed, the switching unit couples the i-th data line to a corresponding data output line for a first period in one frame, and couples the i-th data line to the sensing line for a second period in the one frame.

11. The organic light emitting display device of claim 10, wherein the switching unit does not supply a write control signal to a corresponding write control line.

12. A method of driving an organic light emitting display, the method comprising:

generating a write control signal;

selectively not supplying the write control signal to one write control signal line of a plurality of a control signal lines and supplying the write control signal to remaining write control signal lines of the plurality of the control signal lines;

emitting light from first pixels based on first data signals of first data lines corresponding to the remaining write control signal lines; and sensing degradation information of an organic light emitting diode or threshold voltage/mobility information of a driving transistor of each of second pixels of a second data line corresponding to the one write control signal line that does not supply the write control signal, wherein the sensing of the degradation information or threshold voltage/mobility information includes:

charging a third voltage corresponding to the first data signals supplied to the second pixels through the second data line, in response to a first sensing control signal; and discharging the third voltage, in response to a second sensing control signal, and wherein the second pixels do not emit light.

13. The method of driving an organic light emitting display of claim 12, wherein the sensing of the degradation information or threshold voltage/mobility information includes:

supplying the first data signals to the second pixels for a first period in one frame; and measuring a first voltage while receiving a first current from the driving transistor for sensing the threshold voltage/mobility information of the driving transistor, or measuring a second voltage while supplying a second current to the organic light emitting diode for sensing the degradation information.

14. The method of driving an organic light emitting display of claim 13, further comprising:

converting the first voltage and the second voltage to a first digital value and a second digital value; and generating input data based on the first digital value and the second digital value, wherein the input data is driven as second data signals to the data lines.

* * * * *